United States Patent [19]

Fujikawa et al.

[11] Patent Number: 4,683,847

[45] Date of Patent: Aug. 4, 1987

[54] VALVE SYSTEM FOR OVERHEAD VALVE TYPE FOUR-CYCLE ENGINE

[75] Inventors: Tetsuzo Fujikawa, Kobe; Makizo Hirata; Shinichi Tamba, both of Kakogawa, all of Japan

[73] Assignee: Kawasaki Jukogyo Kabushiki Kaisha, Hygo, Japan

[21] Appl. No.: 811,890

[22] Filed: Dec. 20, 1985

[30] Foreign Application Priority Data

Dec. 27, 1984 [JP] Japan ..... 59-280896

[51] Int. Cl.[4] ..... F01L 1/04

[52] U.S. Cl. ..... 123/90.2; 123/90.39

[58] Field of Search ..... 123/90.2, 90.21, 90.1, 123/90.39

[56] References Cited

U.S. PATENT DOCUMENTS

| | | | |
|---|---|---|---|
| 1,248,597 | 12/1917 | Baker | 123/90.2 |
| 1,286,281 | 12/1918 | Gerard | 123/90.2 |
| 1,614,830 | 1/1927 | Crandall | 123/90.2 |
| 1,708,749 | 4/1929 | Adam | 123/90.2 |
| 1,741,090 | 12/1929 | Adam | 123/90.2 |
| 1,817,153 | 8/1931 | Kinder | 123/90.2 |
| 2,485,951 | 10/1949 | Zimmerman | 123/90.2 |
| 2,843,095 | 7/1958 | Prentice | 123/90.2 |

*Primary Examiner*—Ira S. Lazarus

[57] ABSTRACT

A valve system for the overhead valve type four-cycle engine disposing the intake and exhaust valves substantially symmetrically to each other with respect to the cylinder center line, wherein the valve stems are so tilted in the cylinder head that the valve bodies are in juxtaposition close to the cylinder center line. Guide cams are disposed around the circumferential surface of the crank shaft, respectively return back to the same starting point while making two turns, and respectively have one projection in the course of the turn, for driving the intake and exhaust valves. Between the guide cams and the respective intake and exhaust valve, a sliding piece, push rod and rocker arm are provided, and the projection on each of aforesaid cam is designed to be placed at such a position as to engage with the sliding piece to the opening timing of the intake and exhaust valves.

1 Claim, 4 Drawing Figures

VALVE SYSTEM FOR OVERHEAD VALVE TYPE FOUR-CYCLE ENGINE

FIELD OF THE INVENTION AND RELATED ART STATEMENT

This invention relates to a valve system for the overhead valve type four-cycle engine having the intake and exhaust valves on the cylinder head.

Because of their higher combustion efficiency, many more overhead valve type intake and exhaust valve systems are employed than the side valve type valve systems, and so on.

In general, as means driving the intake and exhaust valve system for the overhead valve type four-cycle engine, the cam shaft system has been employed, in which the cam shaft is disposed parallel to the crank shaft in the crank chamber, and connected with the intake and exhaust valves through the tappets and push rods.

With the cam shaft system, however, since the intake and exhaust valves are disposed parallel to each other in juxtaposition, the ingoing and outgoing gases flow counterwise, thus resulting in insufficient gas exchange. On the other hand, for sufficient gas exchange, if the intake and exhaust valves should be disposed substantially symmetrically to each other with respect to the cylinder center line as well as the valve stems be respectively tilted so that the bodies of aforesaid valves are placed close to the cylinder center line to produce cross flow of the gases, the mechanism interconnecting the cam shaft in the crank chamber to the both valves would be exceedingly complex.

And, there has been the overhead cam system in which the cam shaft is disposed in the cylinder head, but since the interconnection mechanism from the crank shaft to the cam shaft is also complex, leading to expensive cost, it doesn't suit for the single-cylinder type or general-purpose engine for which low cost is essential.

OBJECT AND SUMMARY OF THE INVENTION

It can be said that the purpose and object of this invention is to provide a valve system simple in construction and low in cost of the overhead valve type four-cycle engine, which disposes the intake and exhaust valves substantially symmetrically to each other with respect to the cylinder center line, as well as, can drive, without employing the cam shaft according to the prior art, aforesaid valves in said valve system wherein said valve stems are so tilted in the cylinder head that said valve bodies are disposed side by side close to the cylinder center line, for advantageous gas exchange.

To achieve this object, a valve system for the overhead valve type four-cycle engine constructed as stated above according to the invention, comprises, for each intake and exhaust valve, a guide cam disposed around the circumferential surface of the crank shaft, having a shape of a "figure-eight" folding around the crank shaft while returning back to a starting point in two turns, and also having one projection in the course of said turn; a sliding piece having an arm extending sideways at the lower end of the stem thereof and engaging at the other end with said guide cam, and the stem of said sliding piece can slide parallel to the cylinder center line along a guide hole disposed in the cylinder as well as rotate with respect to its own axis; a push rod engaging at the lower end thereof with the top end of said sliding piece and extending essentially parallel to the cylinder center line; and a rocker arm being supported at the center thereof by a journal disposed in the cylinder head, and engaging at one end with the top end of said push rod and at the other end with the top end of the valve stem of the intake or exhaust valve; and said projection on said guide cam for the intake or exhaust valve is disposed at such a place as to engage with said sliding piece at the rotational angle of the crank shaft corresponding to the opening timing of the intake or exhaust valve.

BRIEF DESCRIPTION OF THE DRAWING

In the accompanying drawings, there are shown illustrative embodiments of the invention from which these and other of its objectives, novel features and advantages will be readily apparent.

In the drawings.

DETAILED DESCRIPTION OF PREFERRED EMBODIMENT

Figure 1:
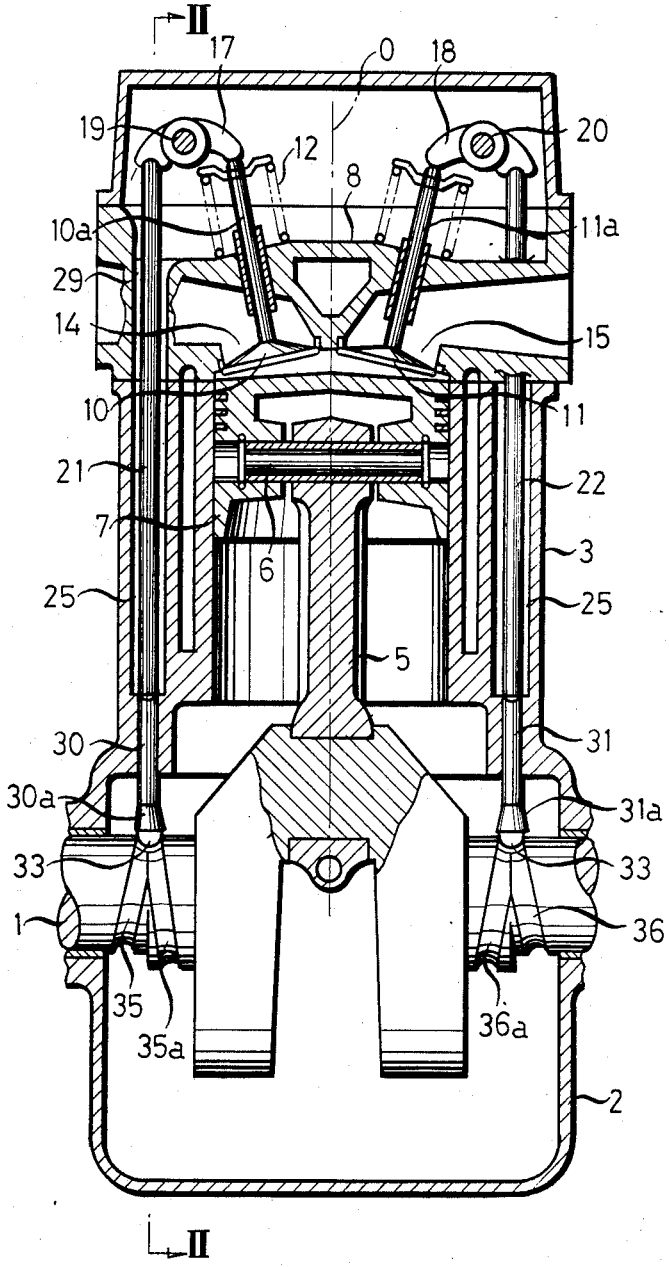
FIG. 1 is a vertical sectional view of an embodiment for a four-cycle engine according to the invention.

FIG. 1 is a vertical sectional view of an embodiment of a single-cylinder engine according to the invention. In FIG. 1, the crank shaft 1 is rotatably supported by the crank case 2 and the cylinder 3 and connected to the piston 7 through the connecting rod 5 and the piston pin 6.

The cylinder head 8 is provided with the intake and exhaust valves 10 and 11 which are respectively supported slidably in the direction of the valve stem. Both valves 10 and 11 are disposed substantially symmetrically to each other with respect to the cylinder center line O and each valve stem 10*a* and 11*a* is so tilted that the valve bodies of both valves 10 and 11 are located close to the cylinder center line O. In other words, the opposedly tilted disposition of both valves 10 and 11 permits the combustion gas flow in a cross-flow fashion.

Both valves 10 and 11 are respectively energized upwards by a valve spring 12 to seat on each valve seat of the intake and exhaust ports 14 and 15. In the upper portion of the cylinder head 8, rocker arms 17 and 18 for the intake and exhaust valves respectively are rotatably supported by journals 19 and 20, one end of each of the rocker arms 17 and 18 engages with the top end of the intake or exhaust valve 10 or 11, and the other end of the rocker arms 17 and 18 engages with the top end of push rods 21 and 22 for driving the valves. Both the push rods 21 and 22 are disposed essentially symmetrically to each other with respect to the cylinder center line, and substantially parallel to said line. The push rods 21 and 22 extend downwards through rod-through holes 29 in the cylinder head 8 and through rod chambers 25 in the cylinder 3, and respectively connect with the top ends of sliding pieces 30 and 31 for the intake and exhaust valves.

Figure 2:
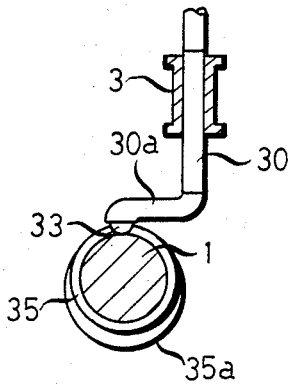
FIG. 2 is a partly sectional fragmentary schematic illustration taken along line II—II in FIG. 1.

Each sliding piece 30 or 31 is slidably supported parallel to the cylinder center line by the cylinder 3, and on the lower end of each sliding piece 30 and 31, as shown in FIG. 2, arms 30*a* and 31*a* sideways extend essentially over the highest longitudinal line on the outer surface of the crank shaft 1, and respectively can rotate about the sliding pieces 30 and 31. Balls 33 respectively are pivoted rotatably on the tip end of the arms 30*a* and 31*a*.

Figure 3:
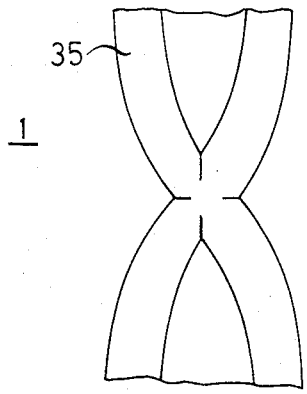
FIG. 3 is a segmentary side view of the guide portion.

On the circumferences at both of the axially opposite sides of the crank shaft 1, guide grooves (guide portion) 35 and 36 are formed for driving the intake and exhaust valves, and the balls for the sliding pieces 30 and 31 respectively engage with the guide grooves 35 and 36, which have such a shape as a "figure-eight" or lemniscate folding around the crank shaft 1 while returning back to a starting point in two turns, or a cross shape as X in one side view (see FIG. 3). And the roots of the guide grooves 35 and 36 are formed as cam faces, and higher portions 35*a* and 36*a* are respectively formed so as to extend outwards in the radial direction, and are designed so as to coincide with the crank angle corresponding to each valve opening timing of the intake and exhaust valves 10 and 11.

When the crank shaft 1 rotates, for instance the ball for the intake valve is guided along the guide groove 35, rolls over the length of the guide groove 35 while the crank shaft 1 makes two turns, the push rod 21 is lifted by the higher portion 35*a* to the corresponding exhaust timing, and the intake valve 10 is once lifted through the rocker arm 17. The arm 30*a* swings to the left and right on FIG. 1 respectively by one degree, while the crank shaft 1 makes two turns.

The operation of the exhaust valve 11 is similar to that of the intake valve 10 except for the opening and closing timing. In other words, during the exhaust timing in the course of two turns of the crank shaft 1, the exhaust valve 11 is once lifted by the higher portion 36*a* of the guide groove 36.

Figure 4:
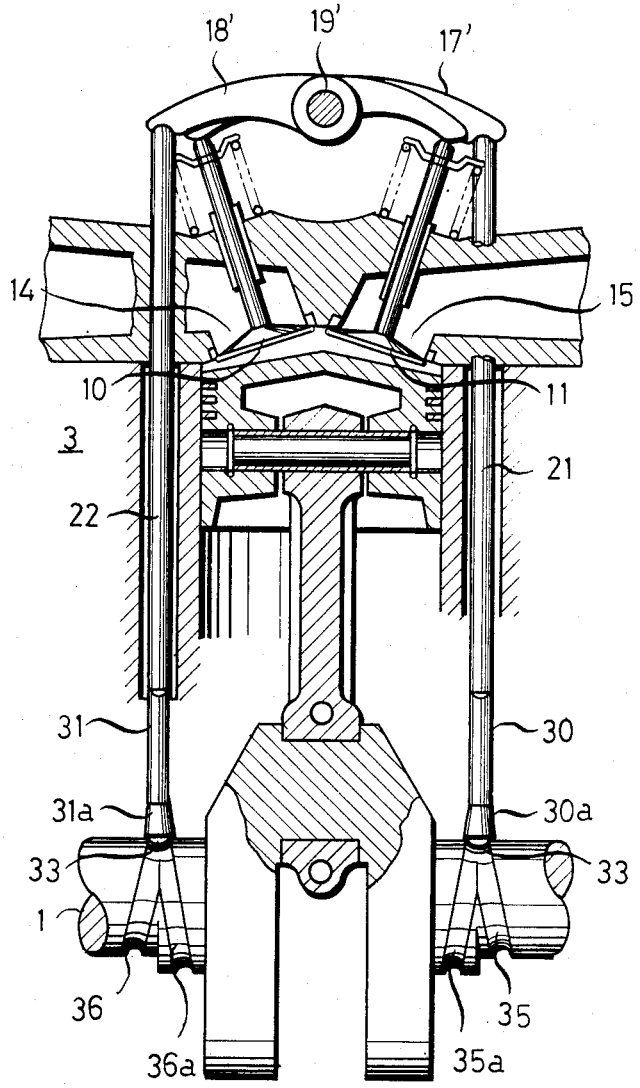
FIG. 4 is a vertical sectional view of another embodiment according to the invention.

In another embodiment according to the invention, as shown in FIG. 4, an intake valve push rod 21 is disposed on the right side of the cylinder for an intake valve 10 located on the left side of the cylinder, and an exhaust valve push rod 22 on the left side for an exhaust valve located on the right side, and rocker arms 17' and 18' for the intake and exhaust valves are supported by a one-piece journal 19'. Other constructions are similar to those in FIG. 1, and the like reference numerals are provided for the like parts as those in aforesaid embodiment in FIG. 1. And the operation of the embodiment in FIG. 4 is also substantially the same as that of the embodiment in FIG. 1.

The guide cams can be formed as guide rails made of metal bar, instead of as the guide grooves.

Further, the guide cams may be formed on one side of the crank shaft instead of on the both sides.

As described above, the invention can provide for:

(a) a substantial reduction in parts cost and a compact size of engine, because of the elimination of the cam shaft for driving the intake and exhaust valves;

(b) the elimination of such need for machining the cam shaft speed-reduction gears and sprockets as required with the cam shaft type system, thus minimizing the time required for machining the valve system, because the intake and exhaust valves are interconnected with the guide portions on the crank shaft only through the sliding portions and the rods;

(c) a higher efficiency of gas exchange, since the gases are designed so as to flow in a cross-flow fashion by means of disposing the intake and exhaust valves essentially symmetrically to each other with respect to the cylinder center line as well as by tilting the valve stems so that the valve bodies for both valves are disposed close to the cylinder center line; and (d) a higher combustion efficiency comparing with the side valve type because of the overhead valve type.

It will be obvious to those skilled in the art that various changes may be made in the invention without departing from the spirit and scope thereof and therefore the invention is not limited by that which is shown in the drawings and described in the specification but only as indicated in the appended claim.

What is claimed is:

1. A valve system for the overhead valve type four-cycle engine disposing the intake and exhaust valves substantially symmetrically to each other with respect to the cylinder center line, wherein the valve stems are so tilted in the cylinder head that the valve bodies are in juxtaposition close to the cylinder center line, comprising; for each cylinder, two guide cams disposed around the circumferential surfaces of two crank shafts extending on each side of a crank pin, each cam having a shape of a "figure-eight" folding around the crank shaft while returning back to the starting point in two turns, and also having one projection in the course of said turn;

two sliding pieces each having an arm extending sideways at the lower end of a stem thereof and engaging at the other end of said arm with one of said guide cams, and said stem of said sliding piece being able to slide parallel to the cylinder center line along a guide hole disposed in the cylinder as well as to rotate about its own axis;

two push rods each engaging at the lower end thereof with the top end of one of said sliding pieces and said two push rods extending essentially parallel to and symmetrical with respect to the cylinder center line; and two rocker arms being supported at the center thereof by a common rocker shaft disposed in the center of the cylinder head, and each engaging at one end with the top end of one of said push rods and at the other end with the top end of one of said valve stems of said intake or exhaust valve; and said projection on said guide cam for the intake or exhaust valve being disposed at such a place as to engage with said sliding piece at the rotational angle of the crank shaft corresponding to the opening timing of the intake or exhaust valve.

* * * * *